US006290081B1

(12) United States Patent
Merey

(10) Patent No.: US 6,290,081 B1
(45) Date of Patent: Sep. 18, 2001

(54) FOLDABLE CONTAINER

(76) Inventor: Thomas Gabriel Bela Merey, R.R. #1, Port Hope, Ontario (CA), L1A 3V8

( * ) Notice: Subject to any disclaimer, the term of this patent is extended or adjusted under 35 U.S.C. 154(b) by 0 days.

(21) Appl. No.: 09/577,976

(22) Filed: May 25, 2000

(30) Foreign Application Priority Data

May 31, 1999 (CA) ..... 2273556

(51) Int. Cl.[7] ..... B65D 6/18
(52) U.S. Cl. ..... 220/7
(58) Field of Search ..... 220/6, 7, 4.28

(56) References Cited

U.S. PATENT DOCUMENTS 3,888,379 * 6/1975 Folberth ..... 220/4.28
4,735,330 * 4/1988 Hoss ..... 220/6
5,632,392 * 5/1997 Oh ..... 220/7
5,746,342 * 5/1998 Jacques et al. ..... 220/6
5,853,099 * 12/1998 Lessard ..... 220/7
6,170,689 * 1/2001 Flesher et al. ..... 220/7

* cited by examiner

*Primary Examiner*—Stephen Castellano
(74) *Attorney, Agent, or Firm*—Birch, Stewart, Kolasch & Birch, LLP

(57) ABSTRACT

A collapsible container has a base and a number of panels which are pivotally mounted to the base. When the container is being stored, the panels lie beside the base or upon the base, one on top of the other. When the container is in use, the panels are upright and define an enclosure. A latch is provided for interlocking adjacent panels. The latch has a slider which is slidable vertically when the container is upstanding and which slides between latch-locking and latch-unlocking positions. The latch further has a catch which is movable horizontally when the container is upstanding and which moves from a locking position for locking adjacent panels to an unlocking position. The latch has means for converting vertical movement of the slider to horizontal movement of the catch.

13 Claims, 8 Drawing Sheets

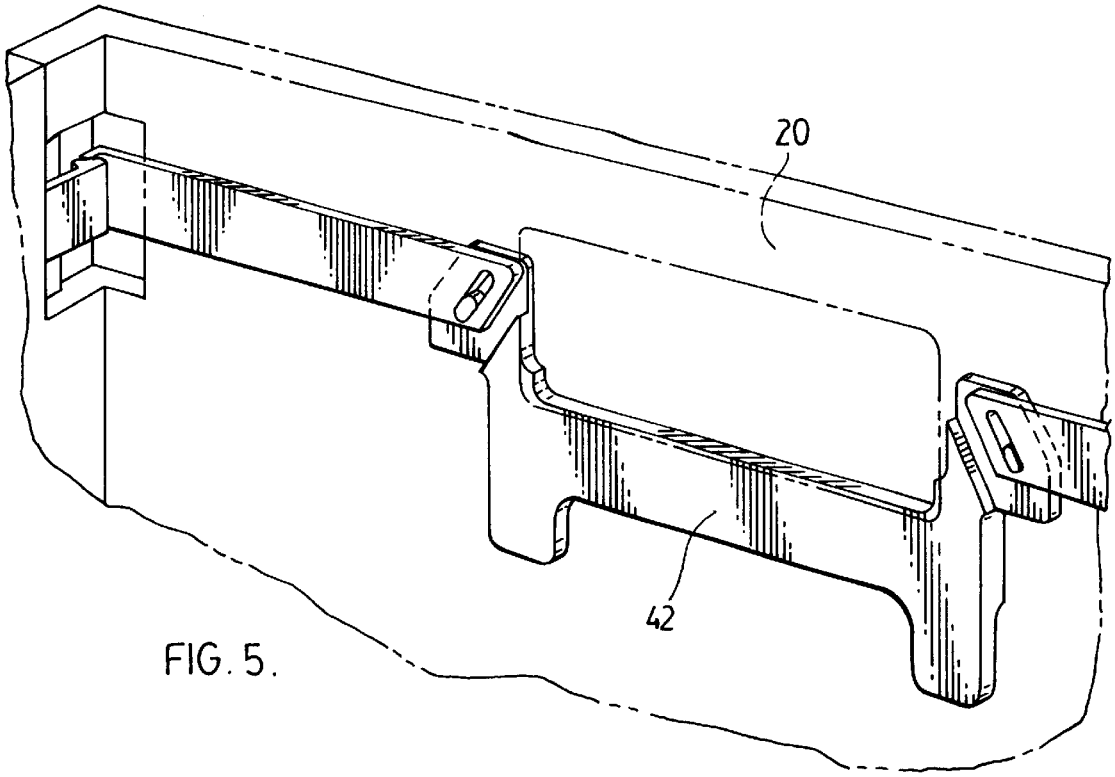
FIG. 5.
FIG. 6.
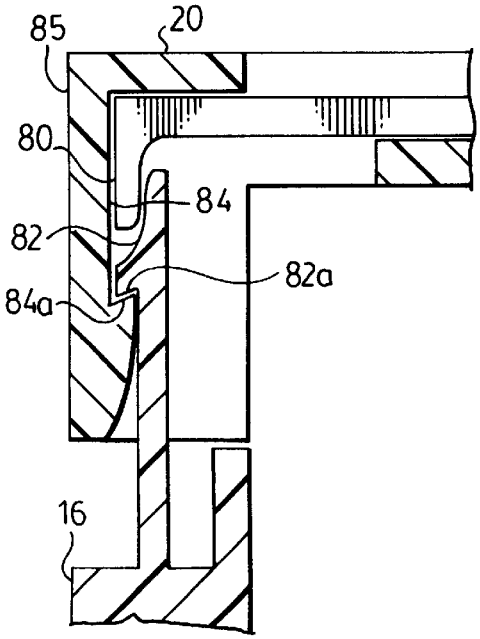
FIG. 7.
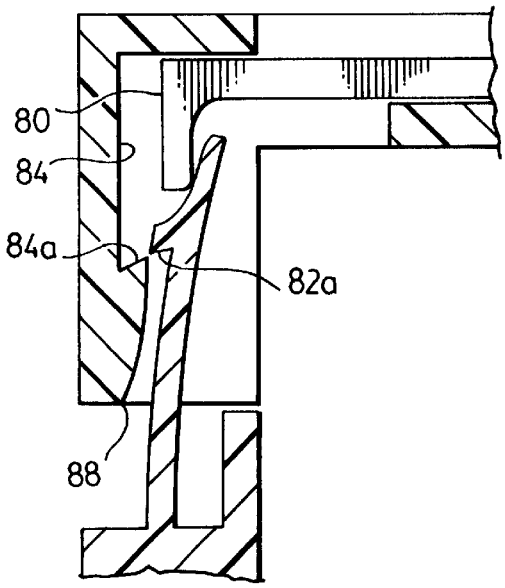

FOLDABLE CONTAINER

This invention relates to a container which is intended to hold produce such as fruit and vegetables. The container is relatively flat for storage and unfolds to an open position for use. More particularly the invention relates to a latch for such a container.

Containers of the type which fold for storage and which unfold or open for use in holding produce are well known. Usually the containers are composed of moulded plastic for lightness and ease in cleaning and are provided with a number of slots for aeration of their contents. The containers have a number of panels which are interconnected by hinges which allow the panels to lie relatively flat when the container is folded for storage. Latches interlock the panels when the container is open or unfolded for use.

A shortcoming of many such containers is that the latches are difficult or inconvenient to operate. Many such latches stick and will not open unless the latch is pushed while the panels are rocked from side to side. Frequently, considerable force is required to move the panels sufficiently for the latch to open. In applying such force, the panels or hinges may break or be severely damaged.

Another shortcoming of other containers is that the latches are located where they are inconvenient to reach. Still other container have latches which are complicated of construction and expensive to manufacture.

An object of this invention is to provide a latch which is conveniently located. The latch may be located near the handle of the container so that a person carrying the container may reached the latch conveniently after he has put the container down.

Another object of the invention is to provide a latch which is easy to operate. Pressure on the latch causes it to operate and such pressure is easy to apply. Movement of the panels from side and side is not required to make the latch open.

Broadly described, the latch of the invention is for use in a collapsible container having a base and a number of panels pivotal between a closed position lying in apposition to the base and an open position in which the panels are upright and define an enclosure. The container is upstanding when open and when the panels extend vertically upward from the base. The latch is provided for interlocking adjacent panels. The latch has a slider which is slidable vertically when the container is upstanding and which slides between latch-locking and latch-unlocking positions. The latch further has a catch which is movable horizontally when the container is upstanding and which moves from a locking position for locking adjacent panels to an unlocking position in which the panels are free to pivot to the closed position. The latch has means for converting vertical movement of the slider to horizontal movement of the catch.

The latch of the invention is described in detail with reference to the accompanying drawings in which:

FIGS. 3 and 5 are perspective views of portions of the inside wall of an end panel of the container;

FIG. 4 is a section on line 4—4 of FIG. 3;

FIG. 6 is a section on line 5—5 of FIG. 3 showing the latch closed;

FIG. 7 is a section on the same line as in FIG. 6 except that the latch is shown open;

Like reference characters refer to like parts throughout the description of the drawings.

Figure 1:
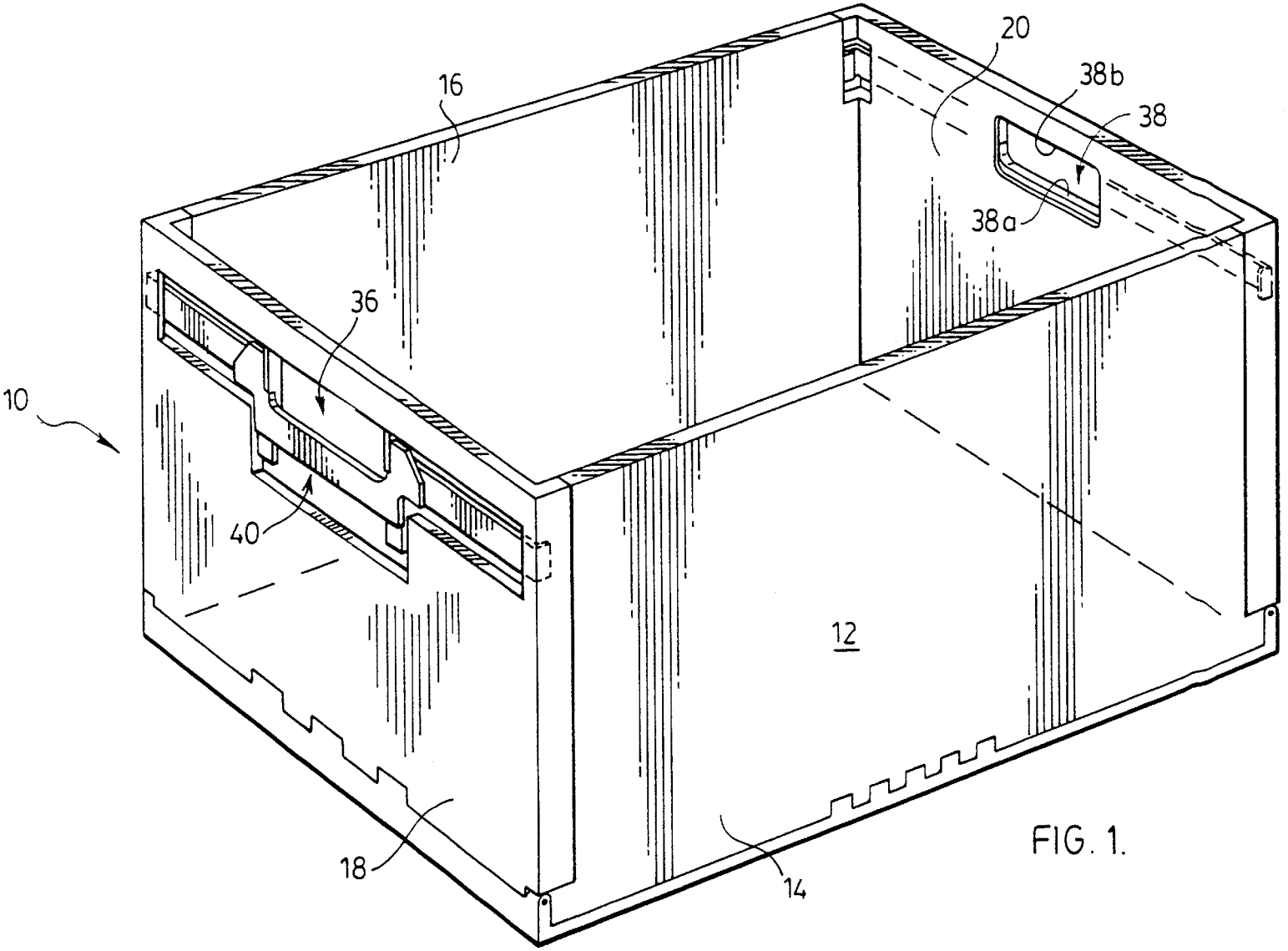
FIG. 1 is a perspective view of a container open for use and showing the outside and inside walls of the latch of the invention.
Figure 2:
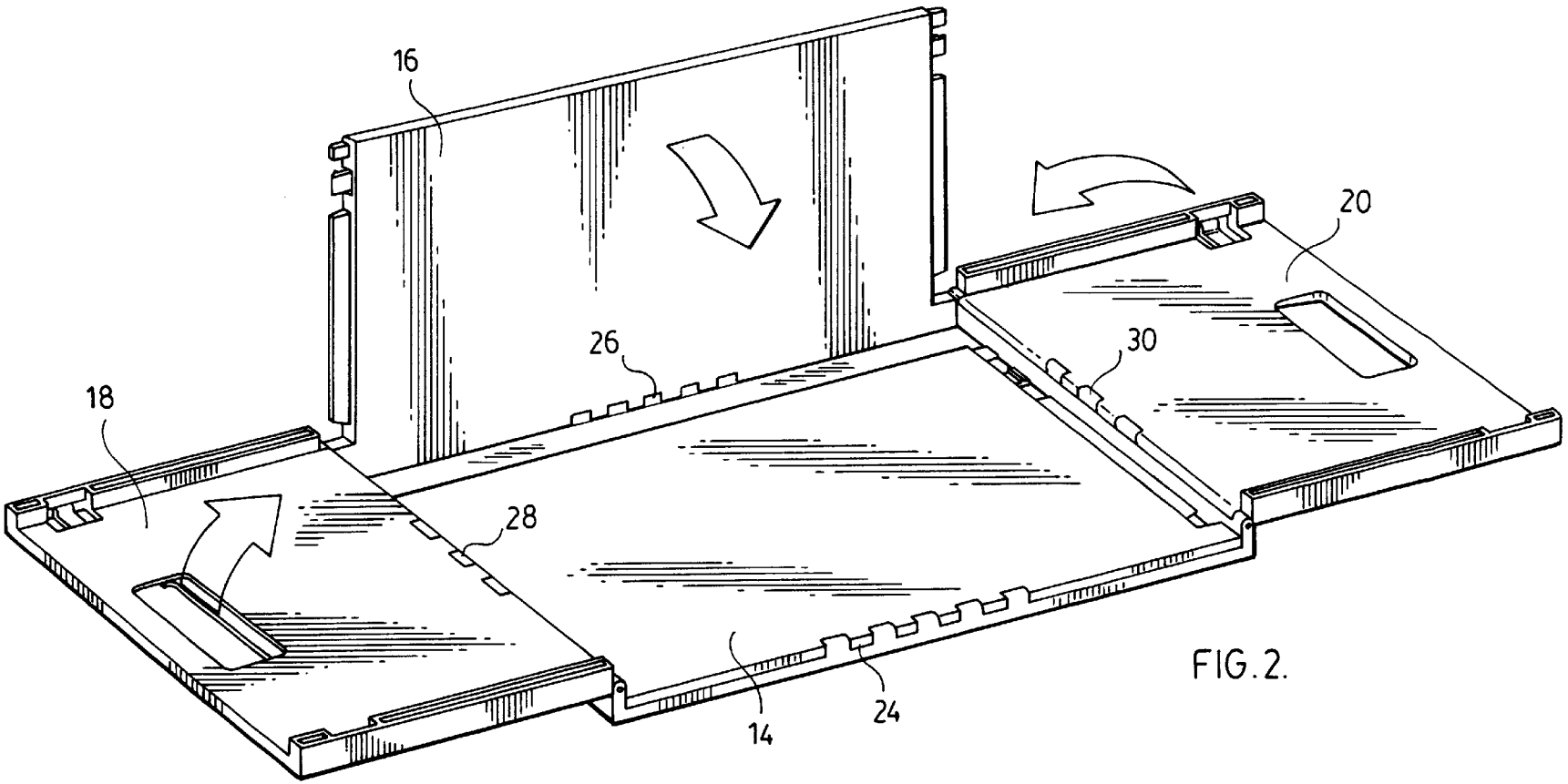
FIG. 2 is a perspective view of container showing the manner in which its panels are unfolded for use.

With reference to FIGS. 1 and 2, the illustrated container, indicated generally 10, has a bottom panel or base 12, side panels 14, 16 and end panels 18, 20. The side panels are joined to the base by means of elongated hinges 24, 26 and like hinges 28, 30 join the end panels to the base.

Elongated openings 36, 38 are formed on the end panels. When the container is standing up as illustrated in FIG. 1, the panels extend vertically upward from the base and the opening are defined at the bottom by a lower edge 38*a* and at the top by an upper edge 38*b*. The elongated openings serve as a handles for the container and accordingly are of size sufficient to admit the fingers of a human hand.

Figures 3, 4:
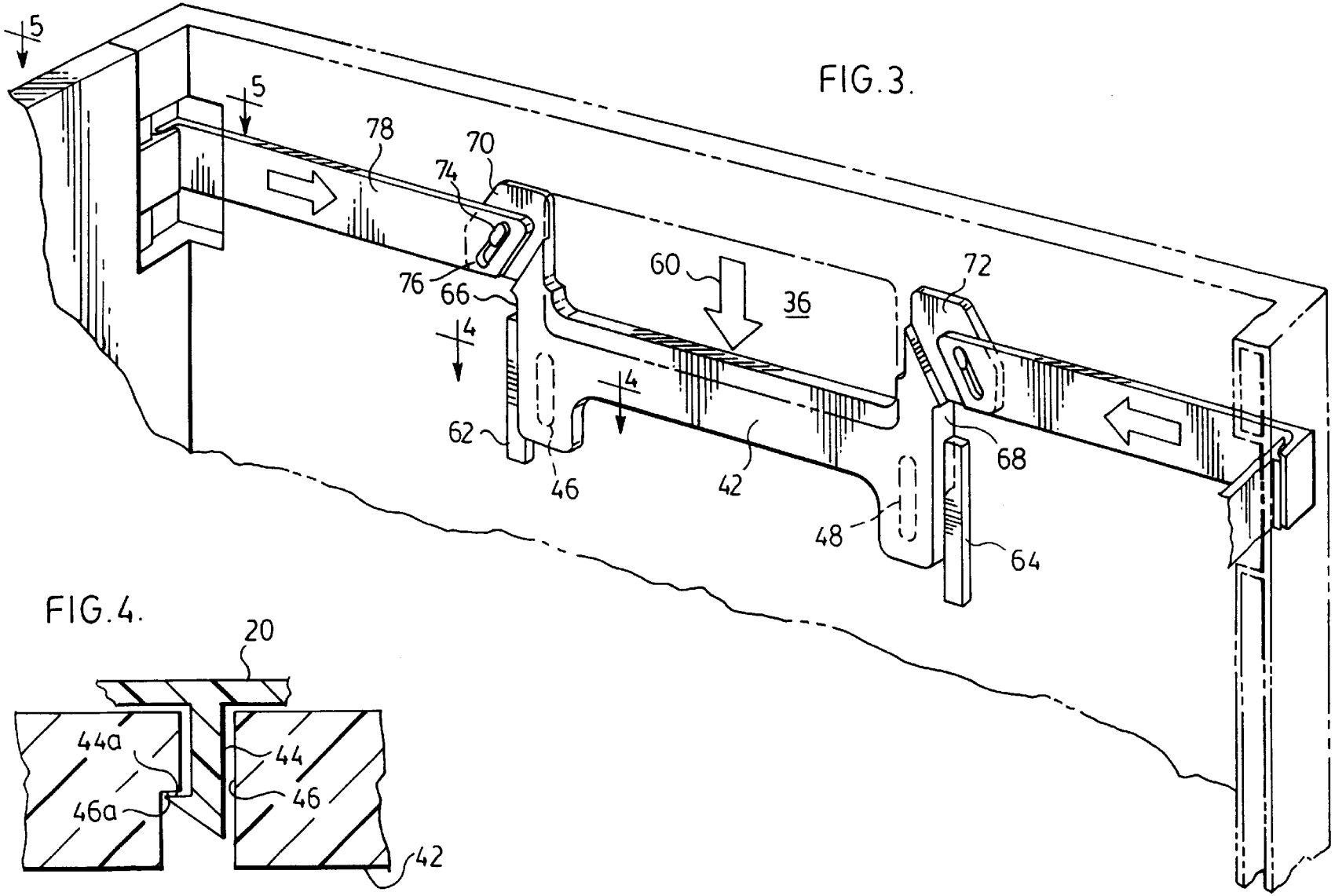

With reference to FIGS. 1, 3 and 4, a latch, generally 40, is positioned beneath each opening and serves to interconnect the end panels to the side panels. The latch includes a slider 42 which is located beneath opening 36. The slider is mounted for sliding to the inner wall of the end panel by means of a barb 44 which is formed on the inside wall of the end panel. A slot 46 is formed on the wall of the slider which faces the end panel. The slider is free to slide up and down in the slot and is held therein by cooperation of the projecting edge 44*a* of the barb with the facing inside surface 46*a* of the slot. A like slot 48 and a barb are formed on the opposite side of the slider Preferably the latch assembly is covered by a panel (not illustrated) to protect it when the container is in use.

The direction of movement of the slider is indicated by arrow 60 and that direction is preferably vertical when the container is resting on a horizontal surface. To that end, the longitudinal axes of slots 46, 48 are oriented vertically. Vertically extending ridges or guides 62, 64 are provided on the end panel for contacting the side edges 66, 68 of the slider. The slots and ridges cooperate to ensure that the movement of the slider is in the desired direction.

Lateral extensions 70, 72 are provided at opposite sides of the slider and a pin 74 extends outwardly from each extension. The pin is received in a slot 76 formed in an end of a latch bar 78. Preferably the angle between the longitudinal axis of the slot and the direction of movement of the slider is about 60 degrees.

As the pin moves downward in the groove, the latch bar moves horizontally inward toward the slider. Movement of the pin upwardly causes the latch bar to move horizontally in the opposite direction. The pin thus cooperates with the groove to convert vertical movement of the slider to horizontal movement of the latch bar.

With reference to FIGS. 6 and 7, the end of the latch bar opposite the slot ends at a flange 80 which extends normally from the longitudinal axis of the latch bar. The flange serves to release a detent or catch 82 which is formed on side panel 16.

With reference to FIG. 6 the catch is shown within a recess 84 formed on an outer extension 85 of the end of end panel 20. The lower edge 84*a* of the recess is bevelled at an angle within the range of approximately 2 to 5 degrees to the horizontal when the container is upstanding. Similarly the lower edge 82*a* of the catch which faces edge 84*a* is bevelled at approximately the same angle and the two edges are parallel to one another. Such bevelling results in a more reliable interconnection of the side panel and the end panel.

With reference to FIG. 7, when the slider is moved downward, flange 80 moves inward and applies an inward force on the catch. The catch is composed of resiliently deformable material and bends inward under such force. As it bends it moves out of recess 84 and unlatches the side panel from the end panel. The side panel can then be separated manually from the end panel.

The catch only bends when a significant downward force is applied to the slider. Otherwise the catch is in the undeformed position illustrated in FIG. 6. Thus when the end panel is to be reconnected or re-latched to the side panel, the two panels are returned to the position illustrated in FIG. 6. The two panels are then pushed together. When so pushed, edge 88 of the end panel contacts the outer wall of the catch and causes the catch to bend inward to clear the edge.

When the catch reaches the recess, the catch will snap outward thereby re-latching the end panel to the side panel. As the catch snaps back it will contact the flange and cause it to move likewise such that it returns to the position illustrated in FIG. 6.

Figure 8:
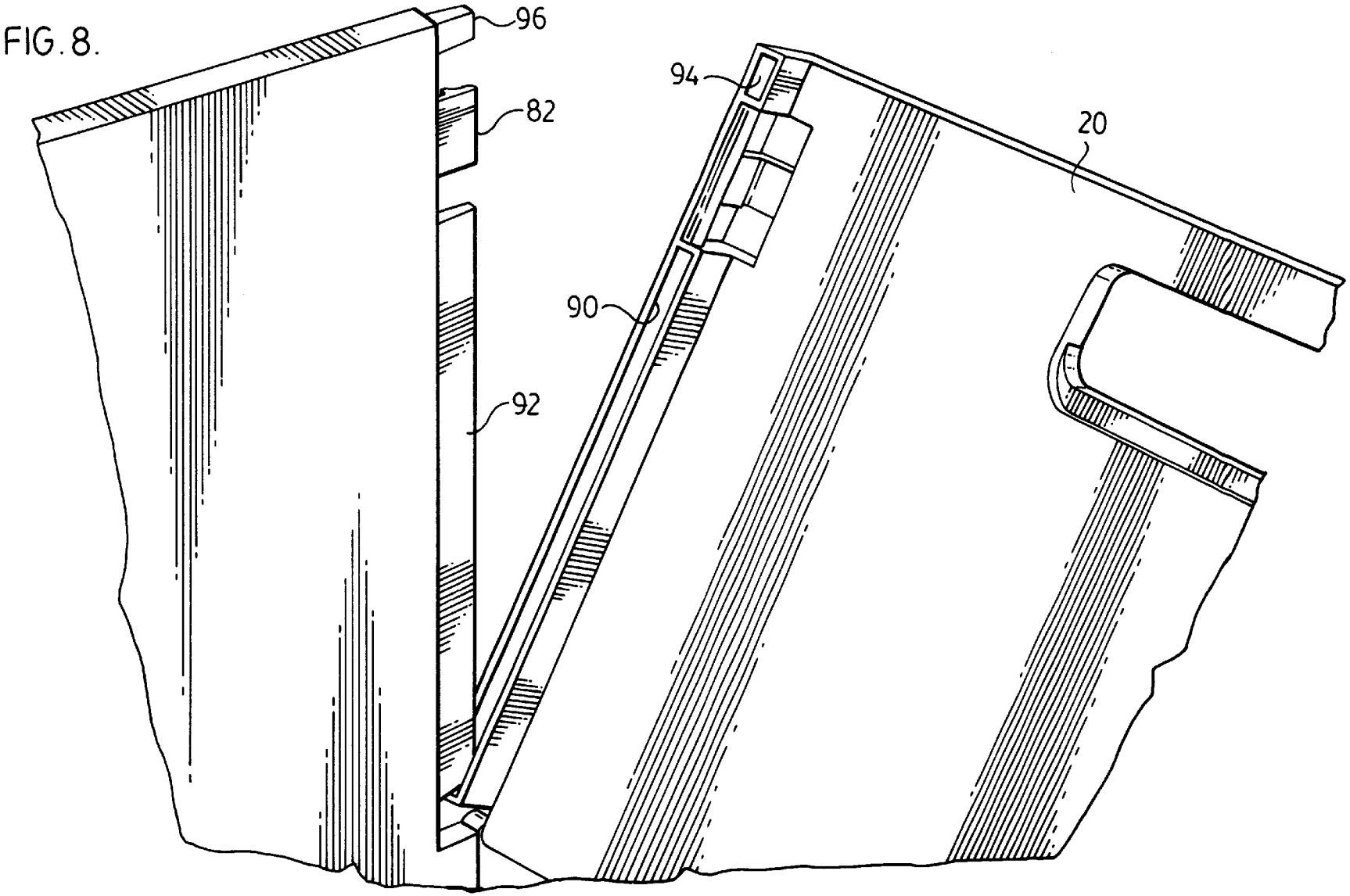
FIG. 8 is a perspective view of the inside walls of portions of the side and end panels of the container.

With reference to FIG. 8 an elongated groove 90 is formed along the edge of the end panel 20 beneath the latch bar and an elongated tongue 92 is formed along the edge of the side panel beneath catch 82. When the two panels are interconnected the tongue is accommodated in the groove. A smaller groove 94 and tongue 96 are formed above the catch and latch bar. The grooves and tongues cooperate to strengthen the corner of the container at which the two panels meet.

In operation, the container is folded for storage from the position illustrated in FIG. 1 by placing a hand in opening 36 and pushing downward on slider 42. Such pushing causes the slider to slide downward from a latch-locking position illustrated in FIG. 1 to a latch-unlocking position illustrated in FIG. 3. As the latch slides downward latch bars 78 on opposite sides of the slider are pulled simultaneously inward toward the slider. At the same time the flanges 80 open catches 82. The end panel may then be separated from the side panels. The operation is repeated at the other end of the container.

After the end panels are separated, the container is folded flat by first folding side panels outward. Next, the end panels are folded outward beside the side panels. The container will then be ready for storage. In some cases it may be desirable for the side and end panels to fold inward so that they are beside each other, one on top of the other. When folded in this way the container is more compact in storage.

Unfolding involves opening the panels as illustrated in FIG. 2 and rotating the side and end panels upward until their edges are adjacent to each other. One end panel is then positioned such that its grooves 90, 94 are adjacent to the tongues 92, 96 at both sides. The end panel is then pushed into contact with the two side panels. As the flanges of the latch contact the catches, they are forced outward by the catches and the latch bars force the slider upward. No springs are necessary for this purpose since the catch, being resiliently deformable serves to bias the slider into the latch-locking position.

Since the latch is adjacent to the lower edge of the opening, fingers within the opening, if raised serve to lift the container and if lowered, contact the latch and cause it to unlock the panels.

Figure 9:
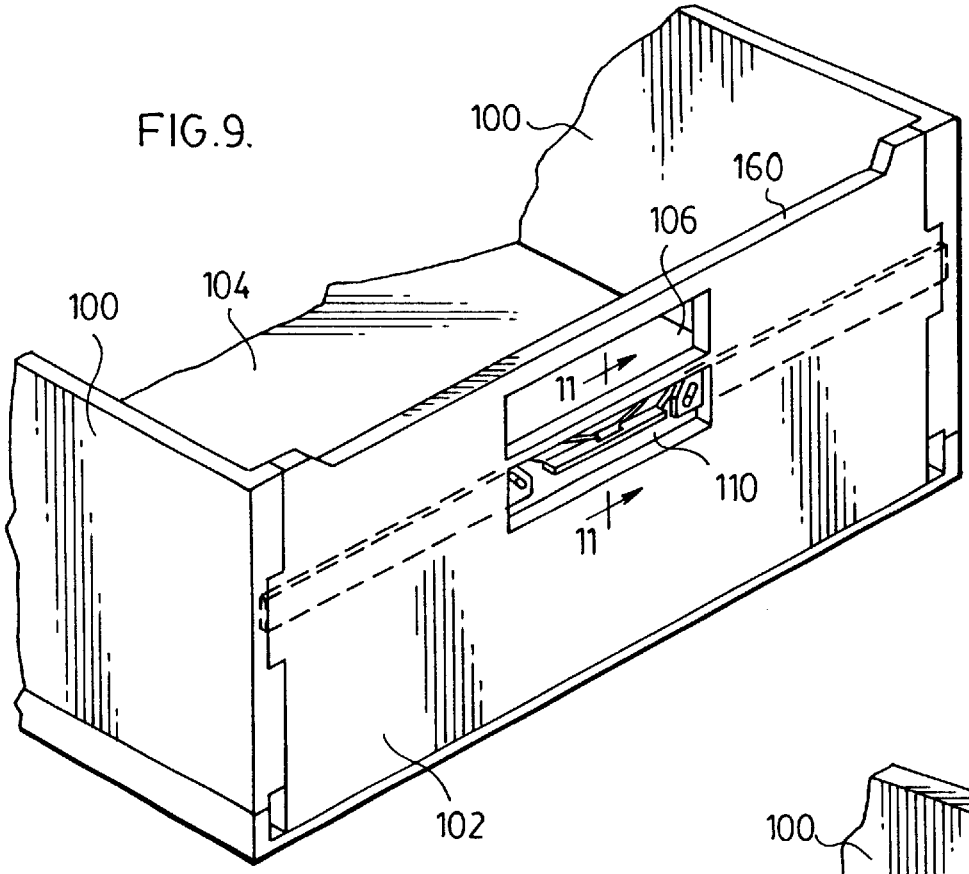
FIG. 9 is a partial perspective view of a second embodiment of the container.

With reference to FIG. 9, the container has side and end panels 100, 102 and a base or bottom panel 104. Like the container illustrated in the previous drawings, the container closes for storage and opens for use. An elongated opening 106 is formed in the end panel and the opening serves as a handle for the container in the conventional manner.

Figure 12:
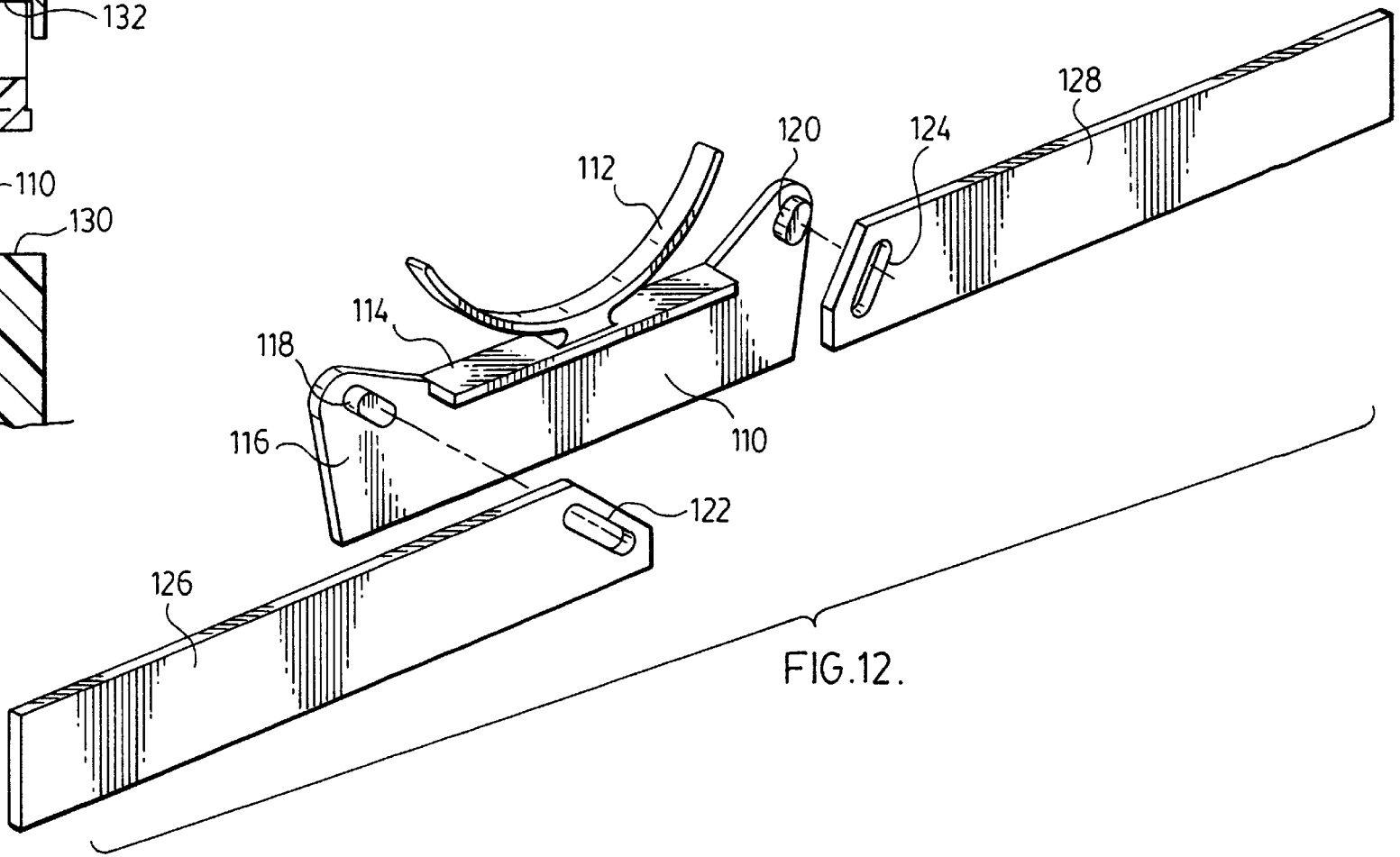
FIG. 12 is an enlarged perspective view of a component of the latch in the second embodiment.

Beneath the opening a slider 110 is mounted. With reference to FIG. 12, the slider includes an arc-shaped spring 112 mounted on a basal support 114. The slider has a lower wall 116 which extends downward from the basal support and a pair of pins 118, 120 extend outwardly from the wall. The pins are received in slots 122, 124 in latch bars 126, 128. The pins and slots cooperate to convert vertical movement of the slider to horizontal movement of the latch bars.

The angle between the longitudinal axis of each slot 122, 124 and the direction of movement of the slider is approximately 60 degrees. The slider and latch bars form a latch as explained below.

The slider is preferably composed of a single piece of moulded plastic which is sufficiently resilient that downward pressure on the spring will cause the spring to resiliently deform. The spring will however return to its undeformed state when the pressure is withdrawn.

Figure 10:
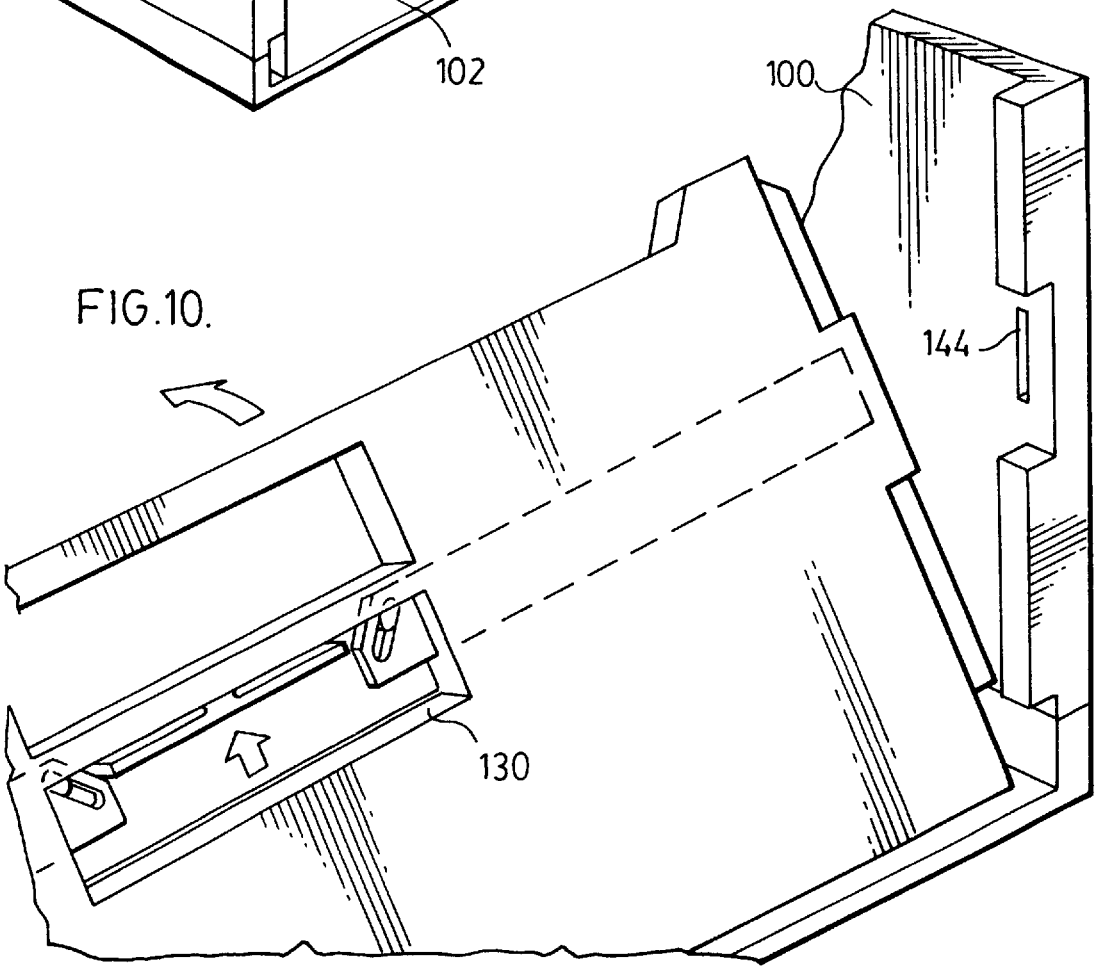
FIG. 10 is an enlarged partial perspective view of the second embodiment showing an end panel separated from a side panel.
Figure 11:
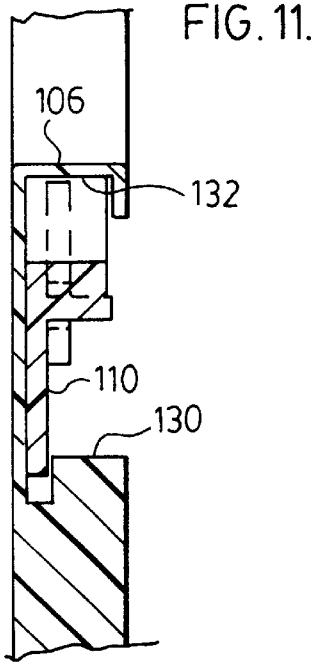
FIG. 11 is a section on line 11—11 of FIG. 9.

With reference to FIGS. 10 and 11, the slider is mounted in a niche 130 in the wall of the end panel beneath the handle. The slider is mounted such that its spring contacts the upper wall 132 of the niche. The latch bars extend through openings in the side walls of the niche and connect to the pins which are adjacent to the side walls.

Figure 13:
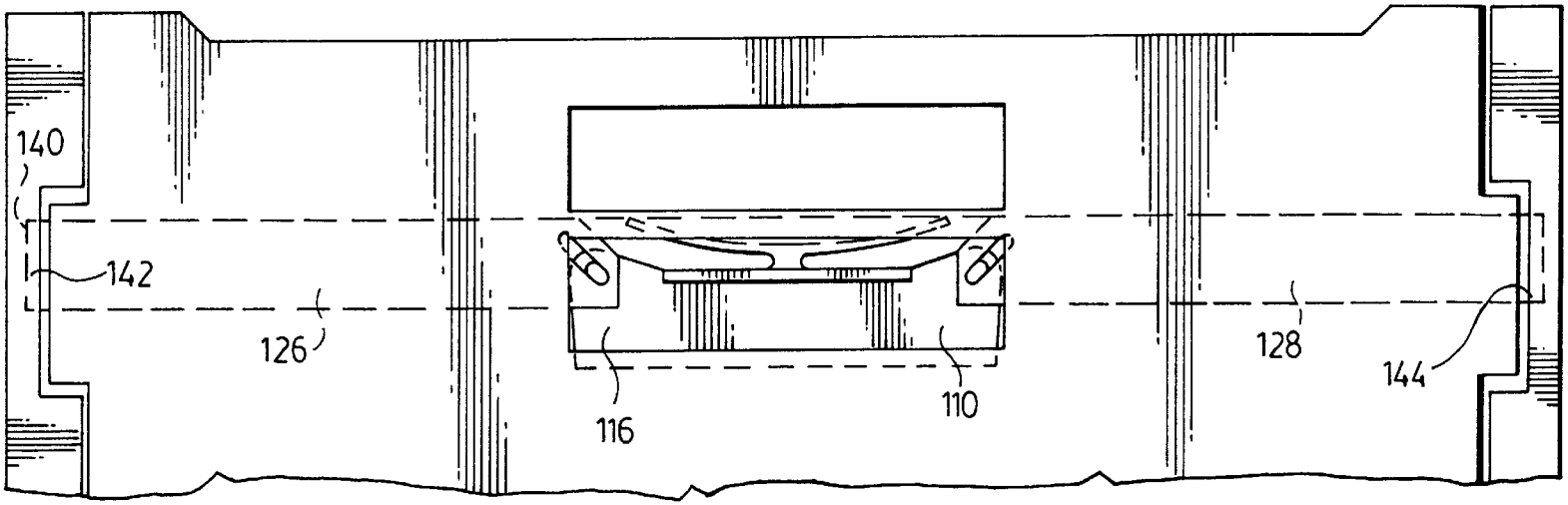
FIGS. 13 and 14 are elevations of the end panel of the second embodiment, in FIG. 13 the latch is closed and in FIG. 14 the latch is open.

With reference to FIGS. 10 and 13 the outer ends 140 of the latch bars remote from the pins extend outwardly of the end panel and into recesses 142, 144 formed in the side panels 100. The outer ends act as catches when the latch bars are in that position and serve to lock the end panel to the side panels. The latch in this position is in a locking position.

Figure 14:
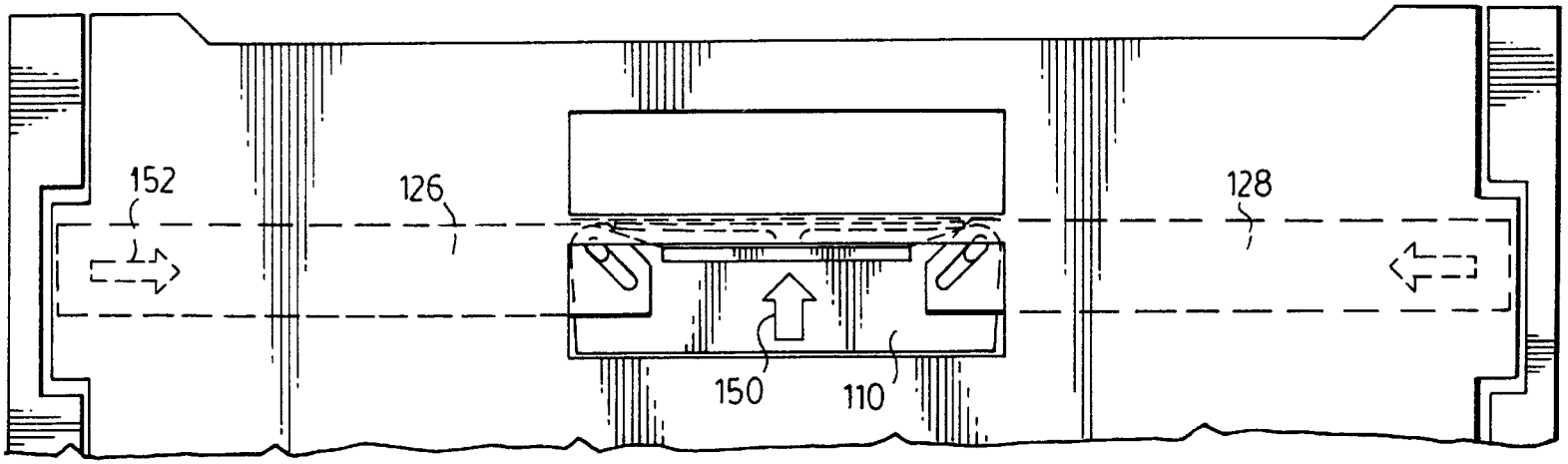

In FIG. 14, upward pressure in the direction of arrow 150 is applied to the lower surface of the basal support 114 of the spring. Such pressure opposes the bias of the spring and causes it to deform resiliently with resulting upward movement of the basal support. As the support moves upward, pins 118, 120 draw the latch bars inward toward the slider in the direction of arrows 152 with resulting withdrawal of the catches of the latch bars from recesses 142, 144. The latch in this position is in an unlocking position. The end panel is then unlocked from the side panels and the panels may be folded for storage.

Opening 106 is spaced apart from the upper edge 160 of the end panel a distance sufficient so that when the fingers of a hand are within the opening, the thumb of the hand can rest on the upper edge 160.

The latch is spaced apart and vertically below the opening when the container is standing up as illustrated in FIG. 9. The distance separating the opening from the latch is such that when the thumb is resting on the upper edge, the fingers can contact the latch and when the hand is squeezed, the bias of the spring is overcome with resulting upward movement of the slider from the latch-locking position to the latch-unlocking position.

It will be understood of course that modifications can be made in the preferred embodiment illustrated and described herein without departing from the scope and purview of the invention as described and claimed herein.

I claim:

1. In a collapsible container having a base and a plurality of panels pivotal between a closed position lying in apposition to said base and an open position in which said panels are upright and define an enclosure, latches being provided for interlocking adjacent said panels, said container being upstanding when open and when said panels extend vertically upward from said base, the improvement wherein said latch has a slider which is slidable vertically when said container is upstanding and which slides between latch-locking and latch-unlocking positions, said latch further having a catch which is movable horizontally when said container is upstanding and which moves from a locking position for locking adjacent said panels to an unlocking position in which said panels are free to pivot to the closed position; and means for converting vertical movement of said slider to horizontal movement of said catch.

2. The container as claimed in claim 1 wherein said converting means includes a latch bar which activates said catch and which is movable horizontally when said container is upstanding, one of said latch bar and said slider having a pin which is received in an elongated slot formed in the other of said latch bar and said slider, said groove being oriented at an oblique angle relative to the vertical when said container is upstanding such that vertical movement of said slider causes said pin to move within said groove with resulting horizontal movement of said latch bar.

3. The container as claimed in claim 2 wherein said groove has a longitudinal axis oriented at an angle of approximately 30 degrees to the vertical when said container is upstanding.

4. The container as claimed in claim 1 further including resilient means for biasing said slider into said latch-locking position.

5. The container as claimed in claim 1 wherein said catch resiliently biases said slider into said latch-locking position.

6. The container as claimed in claim 5 wherein said latch further includes a latch bar mounted to said slider and movable inward toward said slider upon movement of said slider from latch-locking to latch-unlocking positions, said slider being slidably mounted to an end said panel and said end panel being adjacent to a side said panel, said catch being mounted to said side panel, said end panel being engaged to said side panel by means of said catch, sliding of said slider to the latch-unlocking position causing said latch bar to disengage said catch from said end panel, said catch resiliently biasing said slider to the latch-locking position.

7. The container as claimed in claim 6 wherein said catch is disposed in a recess formed in said end panel, said catch having an edge which engages an edge of said recess when said side panels are interconnected, said edges being parallel to one another and oriented at an angle within the range of approximately 2 to 5 degrees relative to the horizontal when said container is upstanding.

8. In a collapsible container having a base and a plurality of panels pivotal between a closed position lying in apposition to said base and an open position in which said panels are upright and define an enclosure, latches being provided for interlocking adjacent said panels, said container being upstanding when open and when said panels extend vertically upward from said base, the improvement wherein at least one of said panels has an opening of size sufficient to admit the fingers of a human hand, said opening having upper and lower edges when said container is upstanding, said latch being adjacent to said lower edge such that the fingers within said opening, if raised, serve to lift said container and if lowered, contact and cause said latch to unlock said panels.

9. The container as claimed in claim 8 wherein said latch includes a slider slidable between latch-unlocking and latch-locking positions; resilient means for biasing said slider into said latch-locking position, said slider being accessible to the fingers within said opening such that if the fingers are lowered the fingers apply on said slider downward pressure which, if sufficient, overcomes the bias of said resilient means and causes said slider to move to said latch-unlocking position.

10. The foldable container as claimed in claim 9 wherein said opening is formed in an end said panel and said end panel is adjacent to a side said panel, said resilient means being a catch mounted to said side panel, said latch further including a latch bar mounted to said slider and movable inward toward said slider upon movement of said slider from said latch-unlocking to said latch-locking positions; said end panel being engaged by said catch to thereby interconnect said side and end panels, sliding of said slider to the latch-unlocking position causing said latch bar to disengage said catch from said end panel, said catch being resiliently biased outward thereby urging said slider to the latch-locking position.

11. The foldable container as claimed in claim 9 wherein said opening is formed in an end said panel and said end panel is adjacent to a side said panel, said latch further including a latch bar mounted to said slider and movable inward toward said slider upon movement of said slider from said latch-locking to said latch-unlocking positions; a flange mounted to said latch bar, said resilient means being a catch mounted to said side panel, said end panel having an outer extension which is engaged by said catch to thereby interconnect said side and end panels, sliding of said slider to the latch-unlocking position causing said latch bar to move inward with resulting inward movement of said flange into contact with said catch thereby causing said catch to move out of engagement with said extension with resulting release of said extension and separation of said end panel from said side panel, said catch being resiliently biased outward thereby urging said slider to the latch-locking position, said slider being caused to move to said latch-unlocking position upon pressure which overcomes the bias of said catch.

12. In a collapsible container having a base and a plurality of panels pivotal between a closed position lying in apposition to said base and an open position in which said panels are upright and define an enclosure, latches being provided for interlocking adjacent said panels, said container being upstanding when open and when said panels extend vertically upward from said base, the improvement wherein at least one of said panels has an opening spaced apart from an upper edge of said panel, said opening being of size sufficient to admit the fingers of a human hand and being spaced apart from said upper edge a distance sufficient so that when the fingers are in the opening, the thumb of the hand can rest on said upper edge, said latch including a slider slidable between latch-unlocking and latch-locking positions, resilient means for biasing said slider into said latch-locking position, said slider being positioned such that when the thumb is resting on said upper edge, the fingers can contact the slider and when the hand is squeezed, the bias of said resilient means is overcome with resulting upward movement of said slider from said latch-locking position to said latch-unlocking position.

13. The foldable container as claimed in claim 12 wherein said opening is formed in an end said panel and said end panel is adjacent to a side said panel, said latch further including a latch bar mounted to said slider and movable inward toward said slider upon movement of said slider from said latch-locking to said latch-unlocking positions, said latch bar having an outer end receivable in a recess formed in said side panel, sliding of said slider to the latch-unlocking position causing said outer end to withdraw from said recess with resulting unlocking of said end panel from said side panel.

* * * * *